US007445677B1

(12) United States Patent
Asplund

(10) Patent No.: US 7,445,677 B1
(45) Date of Patent: Nov. 4, 2008

(54) METHOD AND APPARATUS FOR WASHING OBJECTS

(75) Inventor: Peter Asplund, Hässelby (SE)

(73) Assignee: Gas Turbine Efficiency Sweden AB (SE)

( * ) Notice: Subject to any disclaimer, the term of this patent is extended or adjusted under 35 U.S.C. 154(b) by 0 days.

(21) Appl. No.: 12/124,199

(22) Filed: May 21, 2008

(51) Int. Cl.
*B08B 7/00* (2006.01)
*B08B 7/04* (2006.01)
*B08B 3/12* (2006.01)
*B08B 9/00* (2006.01)

(52) U.S. Cl. ..... 134/24; 134/23; 134/20; 134/22.1; 134/22.18; 134/167 R; 134/134

(58) Field of Classification Search ..... 134/19, 134/20, 22.1, 22.12, 22.18, 23, 24, 32, 33, 134/34, 36, 37, 42, 123, 134, 166 R, 167 R, 134/169 A, 169 R, 167 C, 168 C
See application file for complete search history.

(56) References Cited

U.S. PATENT DOCUMENTS

| | | | | |
|---|---|---|---|---|
| 2,689,456 | A | 9/1954 | White | |
| 3,623,668 | A | 11/1971 | Fried et al. | |
| 4,059,123 | A | 11/1977 | Bartos et al. | |
| 4,065,322 | A | 12/1977 | Langford | |
| 4,196,020 | A | 4/1980 | Hornak et al. | |
| 5,011,540 | A | 4/1991 | McDermott | |
| 5,273,395 | A | 12/1993 | McDermott | |
| 5,868,860 | A | 2/1999 | Asplund | |
| 6,073,637 | A * | 6/2000 | Hayward et al. | 134/22.1 |
| 6,470,668 | B2 | 10/2002 | Payling et al. | |
| 6,478,033 | B1 | 11/2002 | Foster | |
| 6,491,048 | B1 | 12/2002 | Foster | |
| 6,503,334 | B2 | 1/2003 | Ruiz et al. | |
| 6,553,768 | B1 | 4/2003 | Trewin et al. | |
| 6,630,198 | B2 | 10/2003 | Ackerman et al. | |
| 6,932,093 | B2 | 8/2005 | Ogden et al. | |

(Continued)

FOREIGN PATENT DOCUMENTS

| | | |
|---|---|---|
| WO | WO 92/14557 | 9/1992 |

(Continued)

OTHER PUBLICATIONS

Blum, Andrew; "*Sure, a Jet's Wings Need Scrubbing, But Its Guts Need a Flush, Too*;" Wired Magazine, Issue 16.01; Dec. 20, 2007.

*Primary Examiner*—Alexander Markoff
(74) *Attorney, Agent, or Firm*—DLA Piper US LLP

(57) ABSTRACT

A wash apparatus includes a harness assembly comprising a coupling device a coupling device for connecting one or more fluid supply lines to one or more fluid delivery lines; one or more fluid delivery lines removably attached at one end to the coupling device's first portion and positioned for delivering washing fluid directly into the gas turbine engine core as the engine is cranked; one or more fluid supply lines removably attached to the coupling device's second portion for supplying washing fluid to the harness assembly and remaining in a static position relative to the rotating fluid delivery lines; one or more harness rings attached to the one or more fluid delivery lines for spacing, stabilizing, and positioning the fluid delivery lines relative to the fan blades; and a connector for removably attaching the harness assembly directly onto the fan hub.

20 Claims, 6 Drawing Sheets

U.S. PATENT DOCUMENTS

| | | | | |
|---|---|---|---|---|
| 7,198,052 | B2 | 4/2007 | Watt | |
| 7,252,095 | B2 | 8/2007 | Watt | |
| 7,297,260 | B2 | 11/2007 | Hjerpe et al. | |
| 2002/0124874 | A1 | 9/2002 | Butler | |
| 2002/0129837 | A1* | 9/2002 | Ruiz et al. | 134/18 |
| 2003/0209256 | A1* | 11/2003 | Tadayon | 134/10 |
| 2004/0016445 | A1* | 1/2004 | Koch et al. | 134/7 |
| 2004/0028816 | A1 | 2/2004 | Ackerman et al. | |
| 2005/0199270 | A1* | 9/2005 | Watt | 134/22.1 |
| 2006/0048796 | A1 | 3/2006 | Asplund et al. | |
| 2006/0219269 | A1 | 10/2006 | Rice et al. | |
| 2006/0243308 | A1 | 11/2006 | Asplund et al. | |
| 2007/0000528 | A1 | 1/2007 | Asplund et al. | |
| 2008/0040872 | A1 | 2/2008 | Hjerpe | |
| 2008/0078422 | A1 | 4/2008 | Wagner | |
| 2008/0087301 | A1 | 4/2008 | Lee et al. | |
| 2008/0149141 | A1 | 6/2008 | Sales | |

FOREIGN PATENT DOCUMENTS

| | | |
|---|---|---|
| WO | WO 2005/077554 | 8/2005 |

* cited by examiner

METHOD AND APPARATUS FOR WASHING OBJECTS

FIELD OF THE INVENTION

The present invention relates generally to methods and apparatus for washing objects. More particularly, the present invention describes methods and apparatus for effectively and efficiently washing objects, including rotating objects such as gas turbine engines, by delivering washing fluid directly into the object being washed.

BACKGROUND

Certain objects, including without limitation, gas turbine engines, routinely become soiled and coated by air-borne contaminants that enter and adhere themselves to such objects. In the case of a gas turbine engine, these contaminants or fouling typically enter the engine and adhere themselves to the engine fan and compressor blades. These contaminants eventually accumulate on the compressor blades, resulting in a decrease in the effectiveness of the blades in a manner that reduces total air flow and total produced power from the gas turbine engine.

One manner of preventing degradation and of reversing the adverse effects of contaminants is through proper and routine cleaning. Routine cleaning helps maintain turbine engine performance, emissions performance, and intended air flow at their best. Maintaining the intended air flow also assists in maintaining an optimal fuel to air mixture, which further improves the performance and life of compressors.

Existing methods and equipment utilized in cleaning engine compressors include a wash manifold (100) such as is shown in FIG. 1. The manifold (100) includes a plurality of nozzles (101) arranged to dispense a broad stream of washing fluid. In operation, the manifold (100) is typically releasibly mounted on the air inlet of the engine (120), where the nozzles (101) are positioned to direct washing fluid in the air stream up-stream of a fan (111) of the engine (120). Wash fluid dispensed through the nozzles (101) is then used to wash the fan (111) and if arranged properly, to wash components downstream from the fan (111).

Utilizing such methods and equipment, however, is ineffective for removing contaminants that have accumulated downstream of the fan (111). Indeed, since the manifold (100) is positioned upstream of the fan (111), wash fluid dispensed from the nozzles (101) must first collide with the fan's (111) blades. As a result, much of the wash fluid's velocity and volume will be lost before the wash fluid reaches the downstream components. To overcome this loss, additional volumes of wash fluid are dispensed and/or the velocity of the wash fluid is increased. As a result, the cost and time required to complete such a washing procedure are increased.

Accordingly, there is a need for a cost-effective and efficient method and apparatus for cleaning object. In the case of cleaning gas turbine engine, it would be desirable to have a cleaning system and process for rapidly and effectively cleaning the engine's components, including those located downstream of the engine's fan, in a manner that minimizes the volumes of washing fluids used.

SUMMARY OF THE INVENTION

The present invention relates to methods, systems, and apparatus for cleaning objects, including without limit, gas turbine engines. In the case of a gas turbine engine, an exemplary apparatus includes a mobile harness assembly adapted for injecting washing fluid between fan blades and directly into the gas turbine engine's core while the engine is being cranked. The exemplary harness assembly includes a coupling device for connecting one or more fluid supply lines to one or more fluid delivery lines. This coupling device comprises a first portion configured for rotating with the fan hub about the hub's central axis as the engine is cranked, and a second portion configured to remain static relative to said first portion. Attached at one end to the coupling device's first portion are one or more fluid delivery lines which are positioned for delivering washing fluid directly into the gas turbine engine core and for rotating with the fan hub about the hub's central axis as the engine is cranked. Attached to the coupling device's second portion are one or more fluid supply lines for supplying washing fluid to the harness assembly. As a result of the coupling device, the fluid supply lines remain in a static position relative to the rotating fluid delivery lines. The harness assembly also includes one or more harness rings attached to the fluid delivery lines for spacing, stabilizing, and positioning the fluid delivery lines relative to the fan blades and a connector for removably attaching the harness assembly directly onto the fan hub.

An exemplary method includes providing a washing apparatus that includes a harness assembly, such as those configured in accordance with various embodiments of the present invention, and positioning and securing the harness assembly directly onto the fan hub of a gas turbine engine. Once the harness assembly is secured, the gas turbine engine is cranked, thereby causing the fan hub, and the harness assembly secured thereto, to rotate. Washing fluid is supplied to the harness assembly, either prior to or after the engine is cranked, for injecting directly into the engine core as the fan hub rotates.

BRIEF DESCRIPTION OF THE DRAWINGS

For the purpose of illustrating the invention, the drawings show forms of the invention that are presently preferred. However, it should be understood that this invention is not limited to the precise arrangements and instrumentalities shown in the drawings.

DETAILED DESCRIPTION OF THE INVENTION

Disclosed herein are methods and apparatus relating to a mobile wash unit for use in washing objects such as gas turbine engines and/or similar objects. In an exemplary embodiment, the present invention relates to methods and apparatus for injecting uninterrupted stream(s) of wash fluid directly into a gas turbine engine core as the engine is cranked. To that end, the present invention provides a mobile wash unit adapted for cleaning one or multiple engines at the same time, or alternatively in any desired sequence. For this purpose, the mobile wash unit includes one or more units that are each configured for direct mounting onto a fan-hub portion of the engine's fan. Where multiple units would be provided, each unit would be directly mounted onto the fan-hub portion of a different engine. Fluid dispensed from the mobile wash unit is directed to flow between the fan's blades and directly into the engine core. Since the mobile wash unit is mounted directly onto the fan hub, a portion of the wash unit, including the portion that dispenses wash liquid, rotates in unison with the fan hub (and fan blades), thereby maintaining an uninterrupted flow of wash fluid between fan blades and directly into the engine core. Washing a gas turbine engine in this manner not only increases the effectiveness of the wash procedure, but it also decreases the amount of time, wash fluid, and cost required to complete the wash procedure. As a result, users will be able to wash turbine engines (and similar objects) much more frequently, which will extend the life of the engines.

The methods and apparatus described herein allow for great flexibility and diverse applicability. For example, the methods and apparatus disclosed herein may be implemented to effectively wash compressors of free moving gas turbines, such as those used to power aircrafts. In addition, such methods and apparatus are applicable (and cost-effective enough) for use in cleaning compressors of stationary gas turbines, including those that lack a dedicated compressor cleaning system (e.g., peaking, rental units, and mechanical drive turbine operations).

For illustrative purposes, the methods and apparatus of the present invention will be described in the context of use with a gas turbine engine. It should be understood, however, that the methods and apparatus of the present invention are not limited thereto. Indeed, the methods and apparatus of the present invention may be adapted for use in connection with any object that could benefit from fast and efficient washing procedures.

Figure 1:
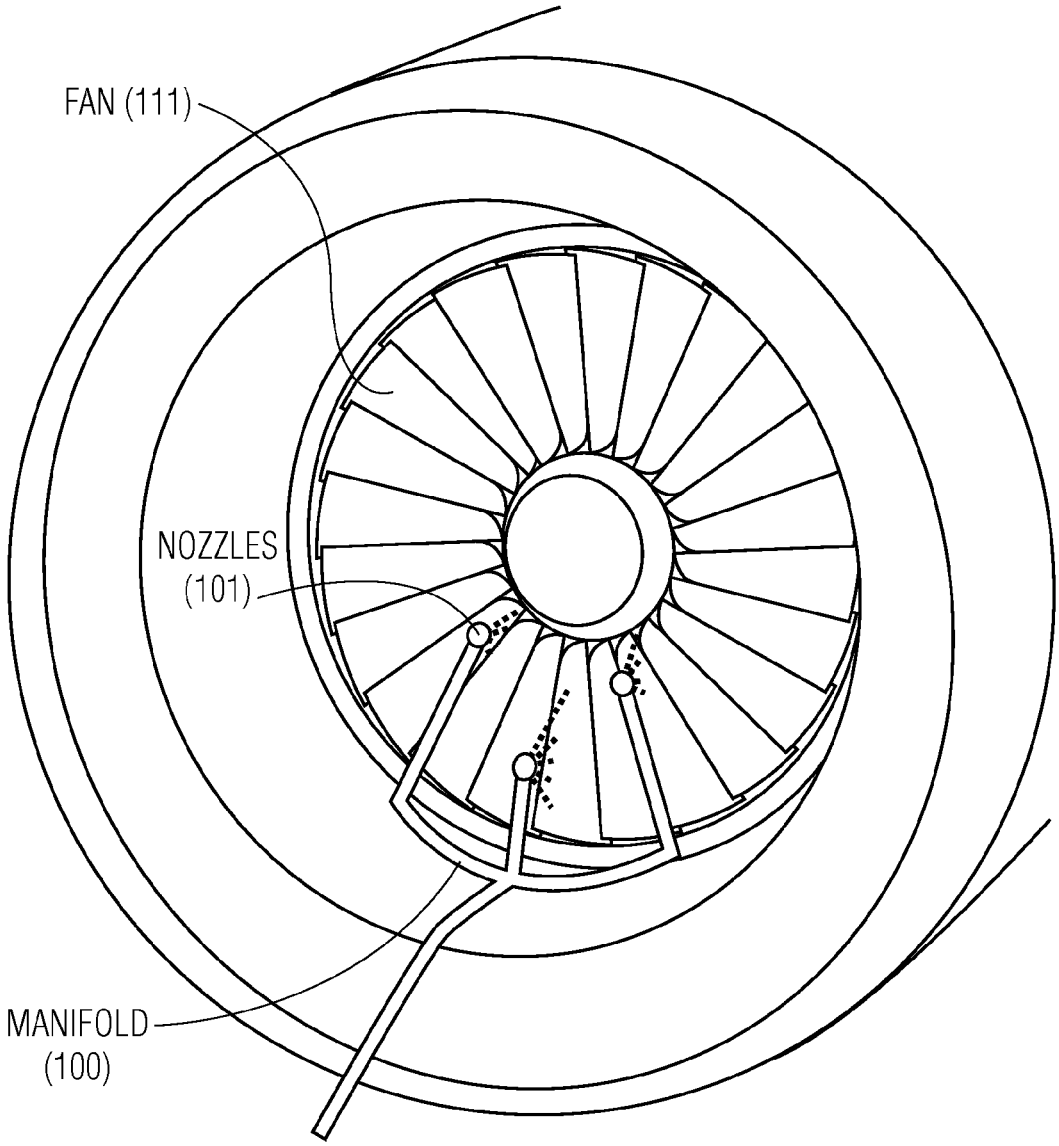
FIG. 1 PRIOR ART
FIG. 1 shows a conventional washing manifold assembly.
Figure 2:
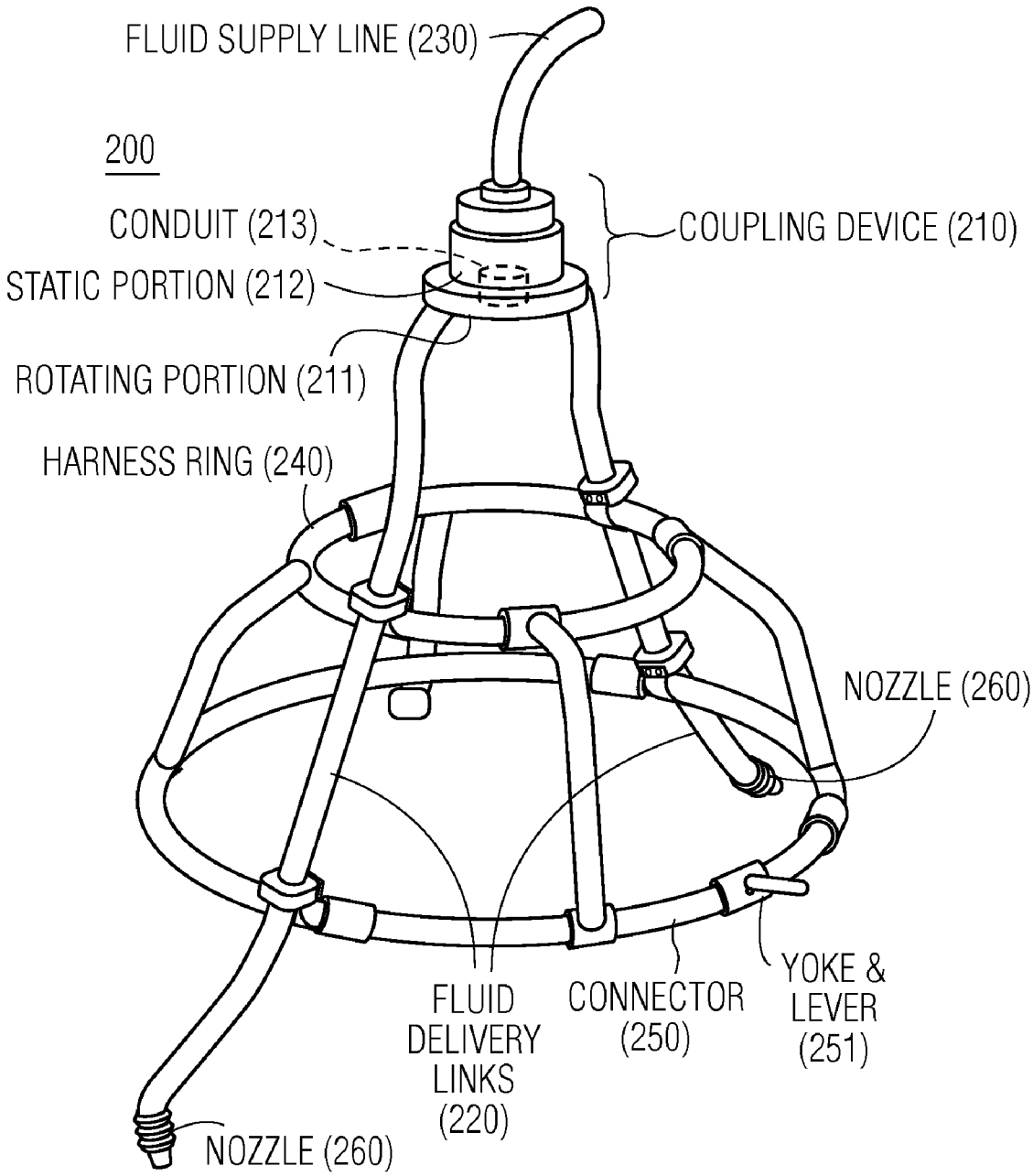
FIG. 2 shows an exemplary wash apparatus configured in accordance with the present invention.

Referring now to FIG. 2, an exemplary wash apparatus (200) configured in accordance with the present invention is shown. The exemplary wash apparatus (200) includes a mobile harness assembly comprising a coupling device (210), one or more fluid delivery lines (220), one or more fluid supply lines (230), one or more harness rings (240), and a connector (250).

The coupling device (210) may be utilized to place the one or more fluid supply lines (230) in fluid communication with the one or more fluid delivery lines (220). To that end, the coupling device includes at least a first portion (211) configured for connecting (or coupling) to the fluid delivery line(s) (220) and a second portion (212) configured for connecting (or coupling) to the fluid supply lines (230). Any type of connection means, such as quick-connect/disconnect connectors, for example, may be incorporated into the coupling device (210) and/or the fluid lines (220, 230) to facilitate connecting to the fluid lines (220, 230) to the coupling device (210).

Aside from connecting to the fluid lines (220, 230), the coupling device (210) may be further configured for rotating the mobile harness assembly during a washing procedure. In such an embodiment, the coupling device (210) may comprise a rotating means (not shown) that enables the first portion (211) of the coupling device (210) and the fluid delivery lines (220) connected thereto to rotate while the second portion (210), and any fluid supply line(s) (230) connected thereto, is permitted to remain static. Such a rotating means (not shown) may be disposed within and/or between the first and second portions (211, 212) of the coupling device (210), or in any other suitable location relative to the coupling device (210). As will be further discussed below, configuring the coupling device (210) in this manner will enable the exemplary wash apparatus (200) to effectively deliver wash fluid, while rotating, without entangling, damaging, or otherwise compromising the fluid supply lines (230).

As noted above, one or more fluid delivery lines (220) may be connected at one end to the first portion (211) of the coupling device (210). These fluid delivery lines (220) may be constructed of flexible hose, hard plastics, polymers, metals, and/or any other flexible or rigid material suitable for delivering washing fluid at various pressure and velocity levels. The connection between the fluid delivery lines (220) and the coupling device (210) may be a temporary or removable connection, as is provided with temporary fasteners (e.g., quick connect/disconnect fasteners), or the connection may be permanent. In either case, according to certain exemplary embodiments, the connection should be able to withstand varying fluid pressures and velocities.

At an opposite end of the fluid delivery lines (220) are one or more nozzles (260) for injecting washing fluid into or onto the object being washed. In the case of a gas turbine engine, for example, the nozzles (260) may be adjusted and/or directed to inject wash fluid directly into the engine core, thereby increasing the effectiveness of the wash fluid. Any form or type of nozzles (260) may be used in connection with the present invention, including (without limitation), single or twin-fluid type nozzles and/or electro-mechanical atomizers that include (without limitation) pressure atomizers, flashing atomizers, electrostatic atomizers, rotary atomizers, ultrasonic atomizers, and the like.

Also attached to the one or more fluid delivery lines (220) are one or more harness rings (240). The harness ring(s) (240) may be disposed between and attached to the fluid delivery lines (220) for positioning, stabilizing, and for maintaining a desired spacing between the fluid delivery lines (220). In one embodiment, the harness ring(s) (240) may be further configured as a conduit for providing a fluid passage between the fluid supply lines (230) and the fluid delivery lines (220). In such an embodiment, rather than coupling the fluid delivery lines (220) directly to the coupling device (210), the harness ring(s) (240) may be coupled to (or otherwise placed in communication with) the coupling device (210). The fluid delivery lines (220), in turn, may then be coupled to the harness ring(s) (240). In effect, the harness ring(s) (240) would serve as a feeder ring with at least one input for receiving washing fluid provided by the fluid supply lines (230), and one or more outputs for providing the washing fluid to the fluid delivery lines (220).

Connected to the second portion (212) of the coupling device (210) are one or more fluid supply lines (230). These fluid supply line(s) (230) may be constructed of flexible hose, hard plastics, polymers, metals, and/or any other flexible or rigid material suitable for delivering washing fluid at various pressure and velocity levels. The connection between the fluid supply line(s) (230) and the coupling device (210) may be a temporary or removable connection, as is provided with temporary fasteners (e.g., quick connect/disconnect fasteners), or the connection may be permanent. In either case, according to certain exemplary embodiments, the connection should be able to withstand varying fluid pressures and velocities.

At an opposite end of the fluid supply line(s) (230) are one or more external fluid source(s) (not shown) for storing, pressurizing, and delivering washing fluid to the fluid supply line(s) (230). This external fluid source (not shown) may be a ground-supported container and/or a mobile container. In one embodiment, the external fluid source (not shown) may be configured with one or more controls for controlling the pressure and/or velocity of the washing fluid. In another embodiment, the pressure and/or velocity of the washing fluid may be controlled remotely.

Also included in the exemplary wash apparatus (200) is connector (250) positioned at a base of the harness assembly for removably attaching the harness assembly to object being washed. In the case of a gas turbine engine, for example, the connector (250) may be configured to attaching the wash apparatus (200) directly onto the fan hub of the engine. The connector (250) may be constructed of any suitable materials, and may include connection means, such as a connection ring comprising a yoke and lever device (251), as is shown in FIG. 2, or any other suitable connection means including a suction device, a clamping device, a connection flange, a band, etc. This connection means may be adjustable so as to enable mounting of the harness assembly on variously sized objects. As illustrated in FIG. 2, one or more fluid delivery lines (220) may be attached to the connector (250) for providing further positioning and stabilization of the lines (220).

In one embodiment, the harness ring (240) may be further configured to function as the connector (250). In other words, the harness ring (240) may itself be equipped with a connection means suitable for connecting the harness assembly to the object being washed. In such an embodiment, this multi-functioning harness ring (240) would eliminate the need for a separate connector.

In operation, the exemplary wash apparatus (200) is sized and positioned onto an object being washed such that the fluid delivery lines (220) and nozzles (260) are positioned and oriented as desired relative to the object being washed. To accomplish this, the harness ring(s) (240) and or connector (250) may be sized and/or adjusted as appropriate for the particular object being washed or the particular wash operation being conducted. Once in position, the apparatus (200) may be temporarily fastened or connected to the object via the connector (250). Then, wash fluid from an external source (not shown) is pressurized and dispensed through the one or more fluid supply lines (230), to the coupling device (210), and out to the fluid delivery lines (220). Since the fluid delivery lines (220) and nozzles (260) have been temporarily affixed in place, fluid dispensed from the apparatus (200) will maintain a consistent flow path onto or into the object being washed. For objects that rotate, the fluid delivery lines (220), by virtue of the rotating coupling device (210), will rotate with the object without causing the fluid supply line(s) (230) to become entangled. Once the washing procedure is completed, the connector (250) may be loosened or released, and the apparatus (200) may be removed from the object.

Figure 3:
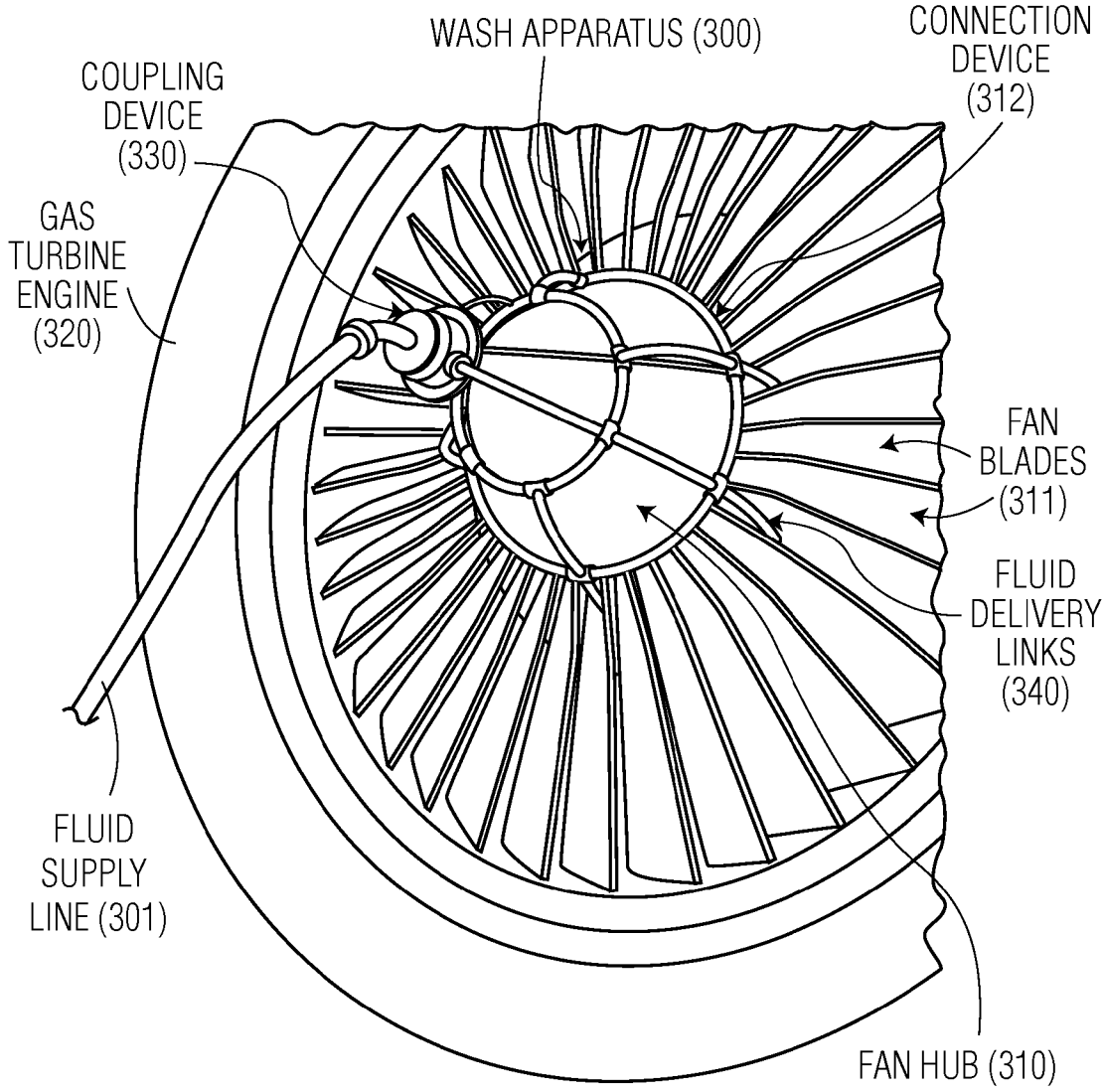
FIG. 3 shows an exemplary implementation of a wash apparatus configured in accordance with the present invention.

Turning now to FIG. 3, a wash apparatus (300) configured in accordance with the present invention is shown mounted onto a fan hub (310) of a gas turbine engine (320). As indicated above, the wash apparatus (300) is first positioned onto the fan hub (310) such that the fluid delivery lines (340) and nozzles (not shown) are directed at the object being washed (320). In this exemplary implementation, the fluid delivery lines (340) are positioned between fan blades (311) for delivering washing fluid directly into the engine's (320) core. Although the fluid delivery lines (340) are shown positioned downstream of the fan blades (311) (i.e., between the fan blades and the engine core), one or more of the lines (340) may be positioned upstream of the fan blades (311).

Once the wash apparatus (300) and fluid delivery lines (340) are in position, the wash apparatus (300) may be secured onto the fan hub (310) via a connection device (312) disposed at a base of the apparatus (300). The connection device (312) may comprise any suitable connection means, including without limitation, a suction device, a clamp, a connection flange, a band, a yoke and lever device, etc.

Once the apparatus (300) is secured, the engine (320) may be cranked, thereby causing the fan hub (310) to rotate. Since the wash apparatus (300) is temporarily affixed to the fan hub (310), the apparatus (300) and the fluid delivery lines (340) will rotate with the hub (310) about the hub's central axis. The rotating coupling device (330) to which the fluid delivery lines (340) are coupled enable the lines (340) to rotate without entangling the fluid supply line (301).

Prior to or after cranking the engine (320), wash fluid may be supplied to the apparatus (300) through the fluid supply line (301) via an external supply source (not shown). This wash fluid may then be provided to the fluid supply lines (340) and injected, via the nozzles (not shown), between the fan blades (311) and directly into the engine core as the fan hub (310) rotates. Since the fluid delivery lines (340) are positioned between the fan blades (311), the flow path of the wash fluid will not be interrupted by the rotating fan blades (311). As a result, the wash procedure will utilize less wash fluid and be more time and cost effective. Once the wash procedure is completed, the connection device (312) may be loosened or released and the wash apparatus (300) removed from the fan hub (310).

Figure 4:
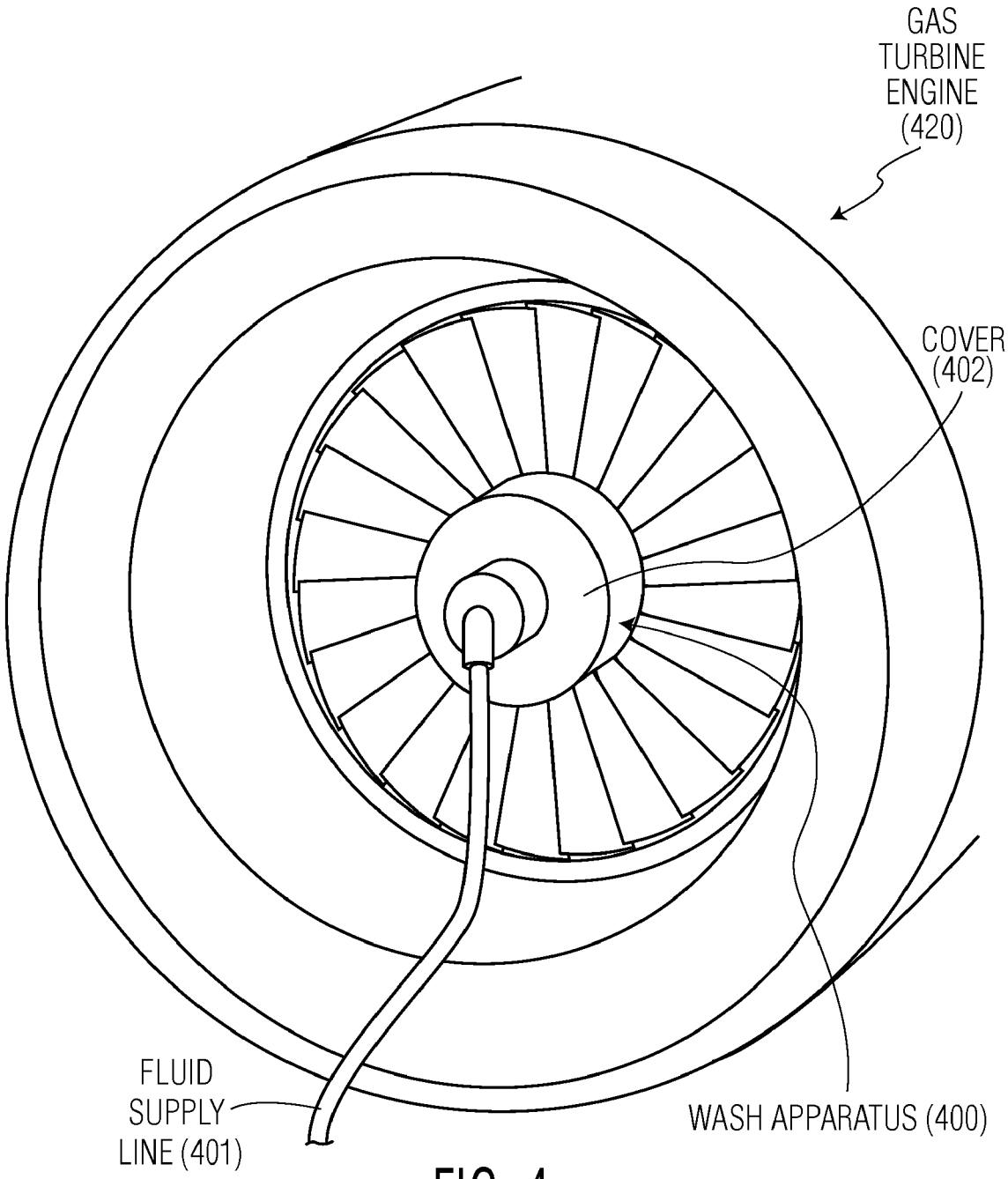
FIG. 4 shows an exemplary wash apparatus configured in accordance with the present invention and comprising an optional cover.

Turning now to FIG. 4, an alternate embodiment of a wash apparatus (400) configured in accordance with the present invention is shown. As shown, the exemplary wash apparatus (400) includes an optional protective cover (402) for enclosing the wash apparatus (400). This protective cover may be made of any suitable material, and may enclose all or a portion of the apparatus (400). As can be appreciated by those in the art, placing a cover (402) over the wash apparatus (400) will serve to protect the internal components of the wash apparatus (400).

Figure 5:
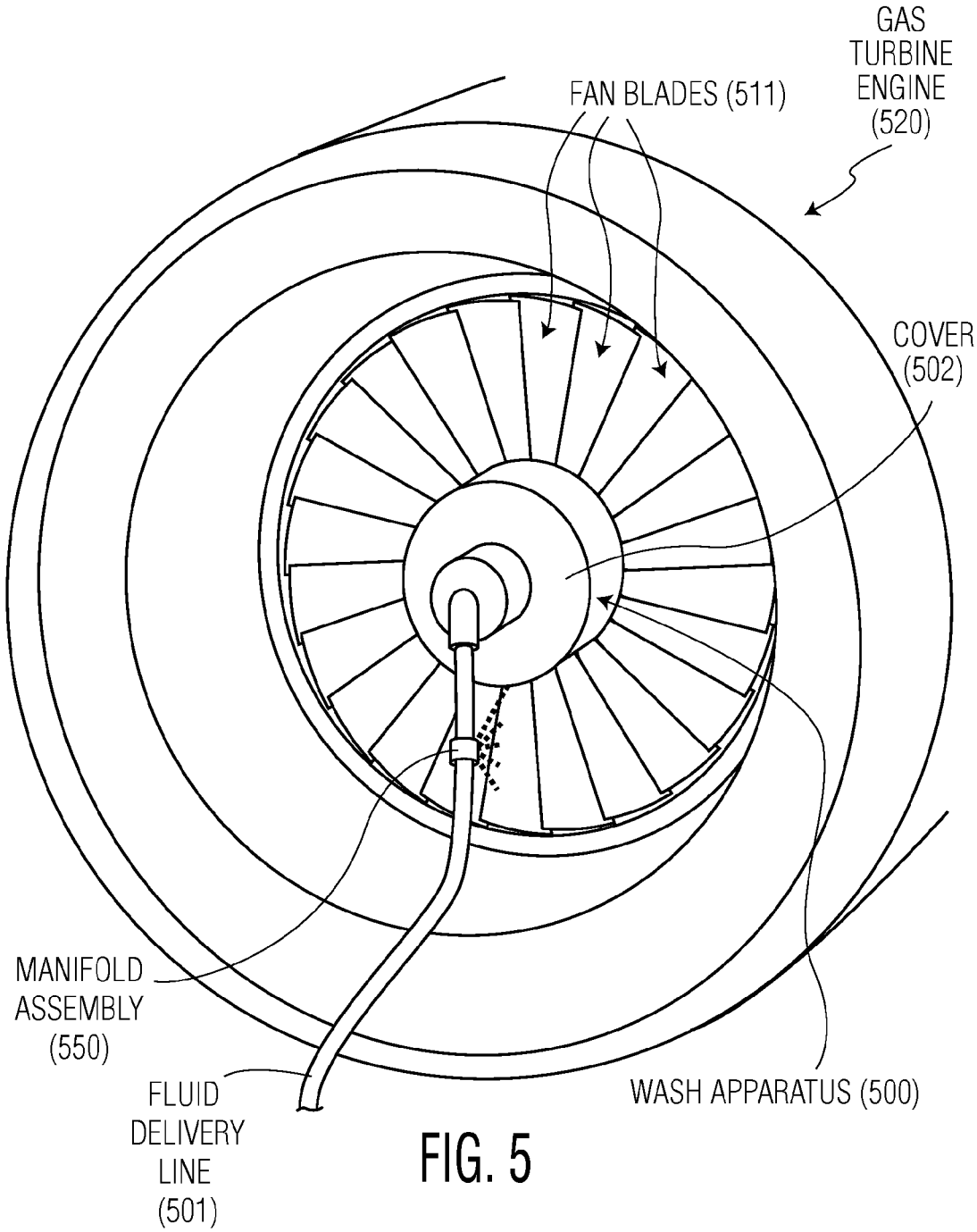
FIG. 5 shows an exemplary wash apparatus configured in accordance with the present invention and comprising an optional manifold assembly incorporated therein.
Figure 6:
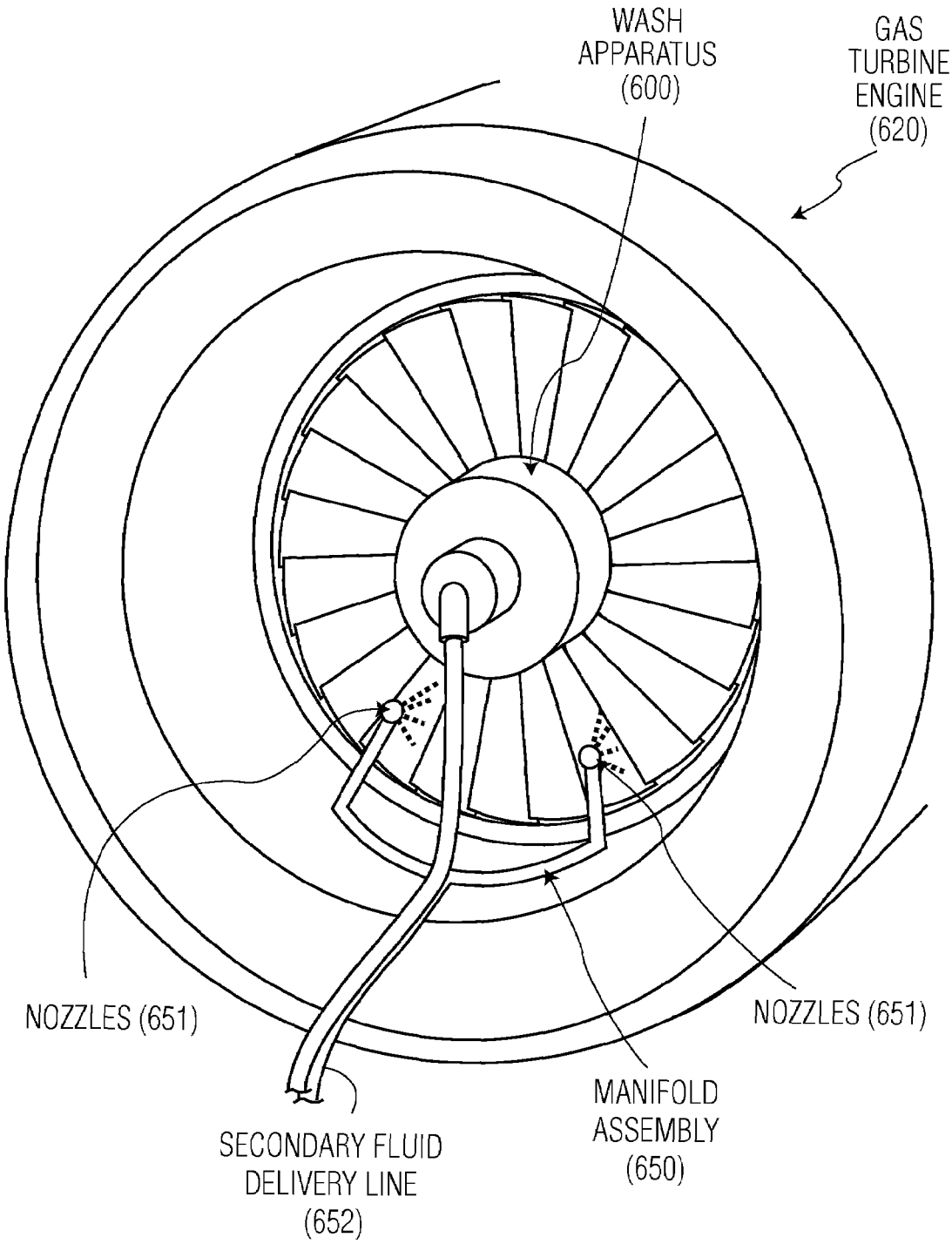
FIG. 6 shows an exemplary wash apparatus configured in accordance with the present invention and comprising an optional independent manifold assembly.

In another embodiment, as shown in FIG. 5, a wash apparatus (500) configured in accordance with the present invention may further include an additional manifold assembly (550) positioned upstream of the fan blades (511). Similar to the wash apparatus (400) of FIG. 4, the wash apparatus of the present embodiment includes an optional cover (502) for surrounding and protecting the wash apparatus (500). Wash fluid is provided to the wash apparatus (500) via its fluid supply line (501). Incorporated into the fluid delivery line (501) is the additional manifold assembly (550) for spraying wash fluid onto the fan blades (511) as the engine rotates while the wash apparatus (500) delivers wash fluid directly into the engine core. This additional manifold assembly may include one or more nozzle incorporated into the fluid delivery line (501), or, as shown in FIG. 6, the manifold assembly (650) may comprise an independent device equipped with its own nozzle(s) (651) and secondary fluid delivery line(s) (652).

Although the invention has been described and illustrated with respect to the exemplary embodiments thereof, it should be understood by those skilled in the art that the foregoing and various other changes, omissions and additions may be made therein and thereto, without parting the spirit and scope of the present invention.

The invention claimed is:

1. A apparatus for cleaning a gas turbine engine, said engine including an engine inlet portion having a fan hub and an array of fan blades connected to and extending radially outward from said fan hub, the apparatus comprising:

a mobile harness assembly adapted for injecting washing fluid between fan blades and directly into the gas turbine engine's core while the engine is being cranked, the harness assembly comprising:

a coupling device for connecting one or more fluid supply lines to one or more fluid delivery lines, said coupling device comprising a first portion configured for rotating with the fan hub about the hub's central axis as the engine is cranked, and a second portion configured to remain static relative to said first portion;

one or more fluid delivery lines removably attached at one end to the coupling device's first portion and positioned for delivering washing fluid directly into the gas turbine engine core, said fluid delivery lines rotating with the fan hub about the hub's central axis as the engine is cranked;

one or more fluid supply lines removably attached to the coupling device's second portion for supplying washing fluid to the harness assembly, said fluid supply lines remaining in a static position relative to the rotating fluid delivery lines;

one or more harness rings attached to the one or more fluid delivery lines for spacing, stabilizing, and positioning the fluid delivery lines relative to the fan blades; and a connector for removably attaching the harness assembly directly onto the fan hub.

2. The apparatus of claim 1, further comprising a cover removably attached to the harness assembly for enclosing at least a portion of said harness assembly.

3. The apparatus of claim 1, wherein the connector comprises a connection ring disposed at a base of the harness assembly and attached to one or more of the fluid delivery lines, said connection ring comprising at least one of a suction, clamping, connection flange, banding, and yoke and lever device.

4. The apparatus of claim 1, wherein the fluid delivery and fluid supply lines each comprise at least one of a flexible hose and a rigid fluid line.

5. The apparatus of claim 1, wherein the harness assembly further comprises a conduit in communication with the coupling device for providing a fluid passage between the fluid supply lines and the fluid delivery lines.

6. The apparatus of claim 1, further comprising one or more nozzles connected to a second end of the one or more fluid delivery lines for injecting washing fluid directly into the gas turbine engine core.

7. The apparatus of claim 6, wherein the harness assembly comprises:

two fluid delivery lines removably attached to the rotating first portion of the coupling device, each fluid delivery line being positioned between two fan blades such that the nozzles attached thereto are positioned at a location that is downstream of said fan blades;

one fluid supply line removably attached to the static second portion of the coupling device;

one harness ring disposed between and connected to the two fluid delivery lines, said harness ring being spaced axially downstream from the coupling device and sized to prevent the coupling device from advancing towards the fan hub; and a harness connector band disposed at a base of the harness assembly for temporarily securing the harness assembly to the fan hub until an engine washing procedure is completed.

8. The apparatus of claim 1, further comprising a manifold assembly positioned upstream of said fan blades and configured for spraying fluid onto the fan blades as said fan blades rotate, the manifold assembly including one or more secondary fluid delivery lines, each comprising one or more nozzles.

9. The apparatus of claim 1, wherein at least one of the harness connector and harness rings are adjustable for sizing the harness assembly according to the size of the fan hub.

10. A method of cleaning a gas turbine engine, said engine including an engine inlet portion having a fan hub and an array of fan blades connected to and extending radially outward from said fan hub, the method comprising:

providing a mobile harness assembly;

positioning and securing the harness assembly directly onto the fan hub;

cranking the gas turbine engine, thereby causing the fan hub to rotate;

supplying washing fluid to the harness assembly; and injecting the washing fluid between fan blades and directly into the gas turbine engine core as the fan hub rotates.

11. The method of claim 10, wherein the mobile harness assembly comprises:

a coupling device for connecting one or more fluid supply lines to one or more fluid delivery lines, said coupling device comprising a first portion configured for rotating with the fan hub about the hub's central axis as the engine is cranked and a second portion configured to remain static relative to said first portion;

one or more fluid delivery lines removably attached at one end to the coupling device's first portion and positioned for delivering washing fluid directly into the gas turbine engine core, said fluid delivery lines rotating with the fan hub about the hub's central axis as the engine is cranked;

one or more fluid supply lines removably attached at a first end to the coupling device's second portion for supplying washing fluid to the harness assembly, said fluid supply lines remaining static position relative to the rotating fluid delivery lines;

one or more harness rings disposed amongst and attached to the one or more fluid delivery lines for spacing, stabilizing, and positioning the fluid delivery lines relative to the fan blades; and a connector for removably attaching the harness assembly directly onto the fan hub.

12. The method of claim 11, further comprising positioning each of the one or more fluid delivery lines between two fan blades for injecting washing fluid downstream of said fan blades and directly into the gas turbine engine core.

13. The method of claim 11, further comprising:

providing a remote washing fluid source;

connecting the washing fluid source to the one or more fluid supply lines; and supplying washing fluid to the harness assembly through the one or more fluid supply lines.

14. The method of claim 13, further comprising heating the washing fluid prior to injecting said fluid into the gas turbine engine core.

15. The method of claim 11, wherein the harness assembly further comprises a cover removably attached to the harness assembly for enclosing at least a portion of said harness assembly.

16. The method of claim 11, wherein the connector comprises a connection ring disposed at a base of the harness assembly and attached to one or more of the fluid delivery lines, said connection ring comprising at least one of a suction, clamping, connection flange, banding, and yoke and lever device.

17. The method of claim 11, wherein the harness assembly further comprises one or more nozzles connected to a second end of the one or more fluid delivery lines for injecting washing fluid directly into the gas turbine engine core.

18. The method of claim 11, wherein the harness assembly comprises:

two fluid delivery lines removably attached to the rotating first portion of the coupling device, each fluid delivery line being positioned between two fan blades such that the nozzles attached thereto are positioned at a location that is downstream of said fan blades;

one fluid supply line removably attached to the static second portion of the coupling device;

one harness ring disposed between and connected to the two fluid delivery lines, said harness ring being spaced axially downstream from the coupling device and sized to prevent the coupling device from advancing towards the fan hub; and a harness connector band disposed at a base of the harness assembly for temporarily securing the harness assembly to the fan hub until an engine washing procedure is completed.

19. The method of claim 11, further comprising:

providing a manifold assembly, said manifold assembly including one or more secondary fluid delivery lines, each comprising one or more nozzles;

positioning the manifold assembly upstream of the fan blades; and spraying fluid, via the manifold assembly, onto the fan blades as the fan blades rotate.

20. The method of claim 11, wherein at least one of the harness connector and harness rings are adjustable, the method further comprising sizing the harness assembly according to the size of the fan hub.

* * * * *